US005413179A

United States Patent [19]

Scott, III

[11] Patent Number: 5,413,179

[45] Date of Patent: May 9, 1995

[54] SYSTEM AND METHOD FOR MONITORING FRACTURE GROWTH DURING HYDRAULIC FRACTURE TREATMENT

[75] Inventor: George L. Scott, III, Roswell, N. Mex.

[73] Assignee: The Energex Company, Roswell, N. Mex.

[21] Appl. No.: 262,770

[22] Filed: Jun. 20, 1994

Related U.S. Application Data

[63] Continuation-in-part of Ser. No. 48,838, Apr. 16, 1993, Pat. No. 5,322,126.

[51] Int. Cl.[6] ..... E21B 43/00

[52] U.S. Cl. ..... 166/308; 166/55; 166/250; 166/299

[58] Field of Search ..... 166/247, 250, 252, 305.1, 166/308, 297, 299, 55, 55.1, 55.2

[56] References Cited

U.S. PATENT DOCUMENTS

| | | | |
|---|---|---|---|
| 4,328,705 | 5/1982 | Gringarten | 73/155 |
| 4,442,895 | 4/1984 | Lagus et al. | 166/250 |
| 4,683,943 | 8/1987 | Hill et al. | 166/299 X |
| 4,714,114 | 12/1987 | Jones | 166/299 X |
| 4,731,531 | 3/1988 | Handke | 250/259 |
| 4,760,252 | 7/1988 | Albats et al. | 250/269 |
| 4,832,121 | 5/1989 | Anderson | 166/254 |
| 4,852,650 | 8/1989 | Jennings et al. | 166/308 X |
| 4,883,956 | 11/1989 | Melcher et al. | 250/269 |
| 4,926,940 | 5/1990 | Stromswold | 166/250 X |
| 4,937,446 | 6/1990 | McKeon et al. | 250/270 |
| 4,947,040 | 8/1990 | Mahdavi et al. | 250/266 |

(List continued on next page.)

FOREIGN PATENT DOCUMENTS

0234731B1 1/1987 European Pat. Off. .

OTHER PUBLICATIONS

Schlumberger booklet, *Gamma Ray Spectrometry Tool*, (Sep. 1983).

Schlumberger Technical Data Sheets TC01 (parts 01 to 12), *Tubing Conveyed Perforating* (1987).

Gardner, et al., "Acids Aided By Microemulsions Increase Permeability," *Petroleum Engineer International*, pp. 27–29 (Jul. 1989).

Taylor III, et al., "Tracers Can Improve Hydraulic Fracturing," *Petroleum Engineer International*, pp. 22, 24–25 (Jul. 1989).

(List continued on next page.)

*Primary Examiner*—Michael Powell Buiz

*Attorney, Agent, or Firm*—Steven G. Lisa; Peter C. Warner

[57] ABSTRACT

A tracer system can monitor in real-time the propagation of a fracture through a rock formation traversed by a well borehole, during hydraulic fracturing processes. The inventive system permits continuous measurement of the movement of gamma-emitting tracers in the fracturing fluid, while the fluid is pumped into the formation. The tracers are injected into the fluid from downhole-placed exploding charges. The fracturing fluid with the tracers passes through perforated production casing into the induced formation fracture, and the tracers emit characteristic gamma radiation. Multiple sodium-iodide scintillometer detectors, arrayed on the logging tool above and below the neutron source, are calibrated to detect the characteristic energy spectra emitted from the activated radioactive tracer isotopes in the fractured formation through the formation rock and the steel production casing and tubing. The detectors pass data to a surface computer system by wireline logging cable or telemetry, allowing graphical display of fracture propagation at the wellsite while the fracturing treatment proceeds. The system allows the operator to control fracture propagation in response to present conditions, preventing "out of zone" fracturing, which can ruin a well. The system helps operators to maximize production while preventing economic waste.

20 Claims, 10 Drawing Sheets

U.S. PATENT DOCUMENTS

| | | | |
|---|---|---|---|
| 4,965,697 | 10/1990 | Mosser et al. | 361/283 |
| 5,025,151 | 6/1991 | Melcher | 250/269 |
| 5,044,436 | 9/1991 | Magnani | 166/247 |
| 5,045,693 | 9/1991 | McKeon et al. | 250/270 |
| 5,046,567 | 9/1991 | Aitken et al. | 166/299 X |
| 5,051,581 | 9/1991 | Hertzog et al. | 250/266 |
| 5,081,351 | 1/1992 | Roscoe et al. | 250/270 |
| 5,094,808 | 3/1992 | Meeh | 376/158 |
| 5,095,983 | 3/1992 | Magnani | 166/250 |
| 5,097,123 | 3/1992 | Grau et al. | 250/270 |
| 5,105,080 | 4/1992 | Stoller et al. | 250/270 |
| 5,165,276 | 11/1992 | Thiercelin | 73/155 |

OTHER PUBLICATIONS

GE Nuclear Energy, *Nuclides and Isotopes: Chart of the Nuclides* (14th ed. 1989).

Schlumberger brochure, "WFL Water Flow Log Service" (Sep. 1990).

Brannon, et al., "Optimize Fracture Conductivity With Breaker Technology." *Petroleum Engineer International*, pp. 30, 32, 35–36 (Oct. 1990).

Schlumberger brochure, *Multiple Isotope Tracer Tool* (Jul. 1991).

Schlumberger Book, *Wireline-Conveyed Perforating* (1991).

Cleary, "Use of Supercomputer Modeling in Hydraulic Fracturing," *In Focus-Tight Gas Sands*, pp. 51–60 (vol. 8, No. 1, Jul. 1992).

Hunt, "Development of an In-Situ Stress Profile Model Using Drilling Parameters, Logs, Mechanical Rock Property Tests and Stress Tests," *In Focus-Tight Gas Sands*, pp. 61–66 (vol. 8, No. 1, Jul. 1992).

Gas Research Institute, Static vs. Dynamic Modulus, Tight Gas Sands Research Program, *GRI Technical Summary* (date unknown).

"Hydraulic Fracturing Research-New Concepts Will Change Industry Practices," *GRI Technology Focus* (date unknown).

"New Borehole Tool Provides More Accurate Downhole Density Determinations," *GRI Technology Focus* (date unknown).

Schlumberger brochure, *Schlumberger's FracHite Log* (date unknown).

Schlumberger brochure, *Dual-Burst TDT Service* (date unknown).

Schlumberger booklet, *Dual-Burst Thermal Decay Time Logging* (date unknown).

Schlumberger brochure, *Gamma Spectrometry Tool* (date unknown).

Schlumberger brochure, *Schlumberger's Natural Gamma Ray Spectrometry Log* (date unknown).

SYSTEM AND METHOD FOR MONITORING FRACTURE GROWTH DURING HYDRAULIC FRACTURE TREATMENT

STATEMENT OF RELATED APPLICATIONS

This is a continuation-in-part of application Ser. No. 08/048,838, filed Apr. 16, 1993, now U.S. Pat. 5,322,126, issued Jun. 21, 1994.

FIELD OF THE INVENTION

The present invention relates to systems and methods for real-time monitoring and control of downhole hydraulic fractures in petroleum reservoirs.

BACKGROUND OF THE INVENTION

Various fracture-stimulation techniques are designed and employed in the petroleum industry for the common end result of placing sand proppant in hydraulically induced fractures to enhance oil or gas flow through a reservoir to the wellbore. Hydraulic fracturing of petroleum reservoirs typically improves fluid flow to the wellbore, thus increasing production rates and ultimate recoverable reserves. A hydraulic fracture is created by injecting a fluid, such as a polymer gelled-water slurry with sand proppant, down the borehole and into the targeted reservoir interval at an injection rate and pressure sufficient to cause the reservoir rock within the selected depth interval to fracture in a vertical plane passing through the wellbore. A sand proppant is typically introduced into the fracturing fluid to prevent fracture closure after completion of the treatment and to optimize fracture conductivity.

Hydraulic fracturing treatment is a capital-intensive process. In addition to the significant cost of a fracturing treatment itself, substantial oil and gas revenues may be gained as a result of a technically successful stimulation job, or lost due to an unsuccessful treatment. The effectiveness of a sand-fracturing treatment depends on numerous critical design parameters, including reservoir rock properties, the vertical proximity of water-productive zones, and the presence or absence of strata that act as barriers. Unsuccessful fracturing treatments typically result from inefficient placement of sand proppant in the induced fracture with respect to the targeted reservoir interval, which sometimes results in excessive water production due to treating "out of zone."

The formation is composed of rock layers, or strata, which include the objective petroleum reservoir, which is often a sandstone interval. When a fracture propagates vertically out of the defined hydrocarbon reservoir boundaries into adjacent water-productive zones, the well may be ruined by excessive water flow into the wellbore, or added expenses and disposal problems may be caused by the need to safely dispose of the produced brine water. Also, if the fracture propagates into an adjacent non-productive formation, the sand proppant may be wasted in areas outside the objective, and the treatment may not be effective. Either situation results in dire economic consequences to the well operator. Although it is sometimes possible to save a well that has been fractured "out of zone," the remedy is extensive, risky, and costly.

Present petroleum technology cannot readily predict when a hydraulic fracturing treatment will result in treating out of zone. The problem may be caused by too little or poor-quality cement between the well casing and the rock formation, or it may simply be caused by the absence of harder, fracture-resistant rock layers in the formation, which can act as barriers to the excessive propagation of fractures. Thus, the problem of treating "out of zone" during the hydraulic-fracturing process occurs frequently in industry.

An economical and successful fracture stimulation requires maximum controlled placement of fracture proppant in the reservoir zone, while avoiding treating into water-producing strata. The increased production revenue from successful fracturing treatments amounts to many millions of dollars each year. A successful fracturing treatment is typically evidenced by increased reservoir production performance resulting from concentrated placement of sand proppant in the petroleum reservoir within the induced hydraulic fracture.

Conversely, inefficient fracturing treatments cost the petroleum industry many millions of dollars each year both in foregone revenue from non-production of valuable hydrocarbons and in lost capital expenses associated with well drilling and completion. Indeed, some wells can be ruined entirely from poor fracturing.

Present industry methods for determining whether a fracture treatment has been treated "out of zone" have relied on post-treatment measurements. In such systems, a fracturing treatment is performed, the treatment is stopped, the well is tested, and the data are analyzed. With most known detection systems, moreover, the wait for post-fracturing data can be considerable, even up to several days, which can delay the completion operations, resulting in higher personnel and operating costs.

Specific known techniques for evaluating fracture treatments include the use of seismic hydrophone arrays, ultrasonic televiewers in the fracture interval, temperature surveys, pressure measurement, and flow meters over the fractured interval. However, those systems cannot be used while fracturing fluid is being pumped, because the downhole treating environment is hostile, which can affect the measurements. Also, such systems produce only indirect measurements of fracture propagation, and so they do not provide a good quantitative measurement of fracture height. In addition, some of those methods require the use of adjacent wells or can only be used in wells that are completed as "open hole" wells, that is wells without casing.

One system that falls within that class of techniques but allows measurement during the pumping of fluid is described in U.S. Pat. No. 4,832,121 to Anderson, which discloses a technique for monitoring the temperature near the wellbore as a function of depth. However, such temperature-based systems suffer from the problem of slow feedback from temperature changes, which can result in the "out of zone" problem developing before it is fully detected by the sensors. Also, Anderson's temperature technique has difficulty distinguishing between variations in rock temperature-conductivity and variations in temperature caused by fluid flow. Thus, temperature-measuring systems cannot provide a quantitative, as opposed to a qualitative, measurement of fracture height.

In addition, the particular method taught by Anderson is difficult to use with wells having casing, which is the most common situation. Anderson discloses how to install his system outside (or as part of) the casing while the well is being cased, but the system cannot be similarly installed in pre-cased wells. Anderson says that the system can be used inside the casing for inside the tubing, but such a system would not give reliable temperature readings while the fracturing fluid—which is significantly cooler than the formation—is being pumped nearby. Thus, the Anderson temperature-based system is not well-suited or practical for monitoring of fracture propagation during the fracturing process in most wells.

Another set of known techniques include the injection of radioactive tracer isotopes into the fracturing fluids, fracture proppants, or both during the fluid-injection or sand-injection steps in the fracturing process, allowing quantitative determination of exact fracture height, by a process known as "gamma well logging." However, such systems can determine fracture growth only after a fracturing treatment is completed. Gamma-radiation measurement tools, such as Schlumberger's Multiple Isotope Tracer Tool (MTT) or Schlumberger's Natural Gamma Ray Tool (NGT), can then detect the tracers and collect data that can be analyzed to determine fracture height or the concentration of proppant. The tool is inserted after the fracturing treatment is completed and moved vertically through the formation interval, within the cased wellbore, to detect the placement of tracers in the formation.

However, none of the logging tools offered by Schlumberger or others in industry is capable of detecting the propagation of fractures during the injection of sand-laden fluid, that is, in "real time." In particular, the processed spectral data from logging methods is typically not available concurrent with the fracturing treatment because additional computer processing would be required to distinguish the gamma rays emitted by the tracer isotopes outside the casing from the gamma rays emitted by tracers in the fluid inside the casing. Most existing well-logging tools are not designed for use with the tubing strings that are generally used to pump fluids into the formation, and it is generally considered very risky to pump fluid directly into the well in the presence of a logging tool without using tubing.

Thus, there is presently no method or logging tool available to the petroleum industry for accurate, quantitative measurement of fracture height or proppant placement measurement during the fracturing process.

Existing post-process "logging" or measuring devices are inadequate because operators cannot feasibly stop and restart the fracturing job to take a measurement. Fracturing fluid is generally pumped into the formation at extremely high pressure, to force open the fractures, and an increasing proportion of sand is added to the fluid to prop open the resulting fractures. Stopping the pumping will relieve the pressure, and depending on the point at which it occurs, undesirable results may occur, such as the closing of the fractures, the reversal of fluid flow back into the wellbore, or the build-up of sand in the hole. Then, after the "logging" operation is completed, the pumping cannot be restarted at the point at which it was left off. Instead, the fracturing job would have to be redone from scratch, with unpredictable results, and it may even be impossible or impractical to redo the job at all.

As a consequence, current methods of fracturing are an art, not a science, in that skilled operators must make educated guesses at factors such as the length of the fracturing job and the rate of increase of sand concentration. Current measurement methods allow only a retrospective view of the fracturing job, in other words, only after any damage has already been done.

By contrast, real-time fracture growth monitoring would allow well operators to control fracture dimensions and to efficiently place higher concentrations of sand proppants in the desired reservoir interval. If the fractures came close to extending out of the desired zone, the operator could terminate the fracturing job, automatically or manually. In addition, real-time analysis of the ongoing treatment procedure would allow the operator to determine when to pump greater concentrations of sand proppant, depending on factors such as the vertical and lateral proximity of oil-water contacts with respect to the wellbore, the presence or absence of water-producing strata, and horizontal changes in the physical properties of the reservoir rock.

Thus, it is an object of this invention to provide systems and methods for quantitatively monitoring in real time the developing growth of hydraulic fractures during the hydraulic fracturing process.

It is another object of the invention to provide systems and methods permitting more accurate placement of sand and other proppants in the reservoir via fracturing fluids.

It is another object of the invention to provide systems and methods for allowing better control of the fracturing process.

It is another object of the invention to provide systems and methods for preventing the problem of fracturing "out of zone."

It is another object of the invention to provide systems and methods for improving the reliability of hydraulic fracturing methods.

It is another object of the invention to provide systems and methods for improved automation of the hydraulic fracturing process.

SUMMARY OF THE INVENTION

The inventive system and methods achieve the above and other objects by permitting the continuous monitoring of proppant placement and fracture height growth simultaneously with the injection of fracturing fluids and sand proppant. In one embodiment, a downhole neutron source activates tracer isotopes in the fracturing fluid as they are injected into the formation. A plurality of detectors, such as sodium-iodide scintillometers, are supported both above and below the neutron source at vertical intervals, and across a total vertical distance sufficient to meaningfully measure the growth of the hydraulically induced fracture and the placement of sand proppant over a selected portion of the formation. The detectors are each capable of detecting gamma rays emitted by activated tracers that pass adjacent to, but outside, the well casing. The system can provide the operator at the well site with a real-time graphical or visual display. In another embodiment, downhole radioactive dispersal charges, which may be arrayed at various depths in the hole, are exploded to inject tracers into the fracturing fluid as the fluid passes into the formation.

Use of the invention allows the treatment operator to vary factors such as the concentration of sand in the fluid, the injection rate, and the injection pressure, to control the treatment to prevent problems while maximizing effectiveness. The inventive systems may also be coupled with known techniques of measuring pressure or other variables downhole, which allows added control. In additional embodiments, a computerized feedback system can use the measured data to control fracturing variables automatically.

Other aspects of the invention will be appreciated by those skilled in the art after reviewing the following detailed description of the invention.

BRIEF DESCRIPTION OF THE DRAWINGS

The novel features of the invention are described with particularity in the claims. The invention, together with its objects and advantages, will be better understood after referring to the following description and the accompanying figures, which common numerals are intended to refer to common elements.

DETAILED DESCRIPTION OF THE PREFERRED EMBODIMENTS

Figure 1:
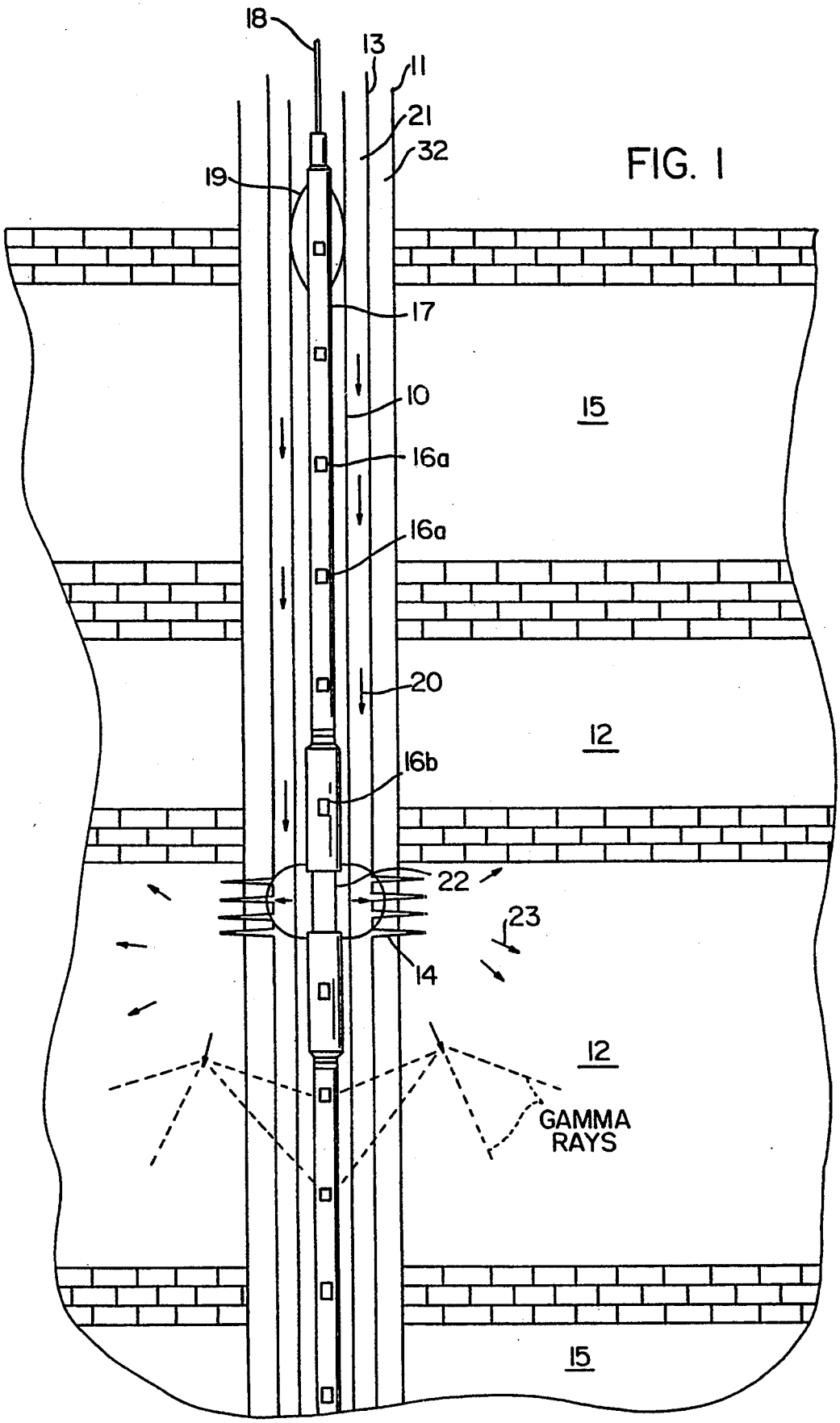
FIG. 1 is a schematic view of a well borehole and illustrates an embodiment of the present invention.

With reference to the drawings, a typical cased well including a representative embodiment of the invention is shown in FIG. 1. Steel tubing string 10 within well borehole 11 transverses a formation composed of rock strata including productive reservoir zones 12. Tubing string 10 is suspended within steel production casing 13. Casing 13 has perforations 14 at a selected interval adjacent to a producing reservoir zone 12. Cement 32 may hold casing 13 within borehole 11.

As a reservoir zone 12 is selected for hydraulic fracture treatment to enhance productivity, a depth interval to be fractured is determined with respect to water-productive zones 15. Tubing string 10 can extend through the entire reservoir interval, or it can terminate at a level higher in the wellbore, depending on the vertical location of the various reservoir and water-productive zones.

A plurality of vertically spaced sodium-iodide scintillometer detectors 16 is arrayed on tool sonde 17 suspended within tubing 10 by conventional logging cable 18. Scintillometer detectors 16 are located both above and below perforations 14. The spacing between vertically adjacent sensors 16 should be selected to provide adequate depth resolution over the thickness of formation to be measured. Enough detectors 16 are used to allow measurement across the entire selected depth interval. The total formation to be measured during a hydraulic fracturing treatment may have a thickness ranging from less than twenty-five meters to more than 250 meters.

Although the sensor string is shown in FIG. 1 as suspended within tubing string 10, it can also be attached to or incorporated in the tubing itself. Bowspring caliper 19 provides tool centralization and several such units can be spaced on the tool sonde 17 as needed.

The fracturing fluid or gel injected into the well contains initially non-radioactive tracer nuclei 20. A neutron-emitting chemical source or electromagnetic-generating neutron minitron 22 is supported by cable 18 amidst scintillometer detectors 16 and adjacent to perforations 14. When neutron-emitting source 22 is active, nuclei 20 in the fracturing fluid are bombarded by neutrons and activated, converting them into radioactive tracer isotopes 23. Activated isotopes 23 then pass through perforations 14 and into the fracture that the fluid is forcing open in reservoir zone 12.

Another logging tool available from Schlumberger, called the Gamma Ray Spectrometry Tool (GST), contains a minitron of a sort generally suitable for use as neutron-emitter 22. The GST emits neutron pulses into the surrounding formation and uses a single detector to measure the gamma rays generated by the resulting epithermal and thermal neutron reactions. The GST has the capability of measuring discrete energy levels, called "energy windows." The data can be transmitted uphole in digital form via a telemetry interface to Schlumberger's Cyber Service Unit computer system at the wellsite. The GST is used to irradiate the formation to determine selected physical characteristics of the rock, such as its level of porosity and its material composition and whether liquid is present, but it is not (and cannot be) used to detect and measure fracture propagation.

However, a preferred embodiment acquires a background measurement of the gamma radiation before activating neutron emitter 22, to establish a baseline over which gamma ray counts and tracer-specific energy levels can be detected. The baseline can be taken while fracturing fluid containing non-radioactive tracer nuclei 20 is present in the annulus 21 between tubing 10 and casing 13, to enable determination of the background gamma energy levels contributed by natural gamma radiation both in the formation and in the wellbore fluid containing non-radioactive tracers 20.

After their activation by emitter 22, gamma-emitting isotopes 23 are characterized by distinctive gamma energy spectra, which are easily measured. Detectors 16 are calibrated with window settings to measure those specific gamma energy levels, or "windows," characteristic of the particular activated, radioactive isotopes 23 selected for use as tracers. A variety of gamma-emitting tracer isotopes are suitable for use with the system of the invention, including for example potassium compounds, which includes both Potassium$^{39}$, activated to Potassium$^{40}$, and Potassium$^{41}$ activated to Potassium$^{42}$ and Potassium$^{43}$. An activated potassium tracer thus would be detected by measuring the products, Potassium$^{40}$ at an energy level of 1460.8 KeV, Potassium$^{42}$ at 1524.6 KeV, and Potassium$^{43}$ at 372.8 and 617.5 KeV.

Other energy levels are produced by the isotopes listed, but the above-listed ones cover the significant emissions, so detectors 16 can be set to capture emissions in or near those energy levels. Additional possible isotopes include Scandium$^{45}$, which becomes activated to Scandium$^{46}$ (at 1120.5 and 889.3 KeV), Scandium$^{47}$ (at 159.4 KeV), and Scandium$^{48}$ (at 983.5, 1312.1, and 1037.5 KeV). Also available as tracers are Iodine$^{127-131+}$, Antimony$^{121-127}$, and other suitable elements. Other suitable available isotopes are listed in the publication entitled "Nuclides and Isotopes" (General Electric Company 14th ed. 1989), which publication is hereby incorporated by reference.

Detectors 16 measure the gamma radiation from the activated tracers by measuring total gamma-ray counts at the "window" energy levels and comparing those measurements with the baseline levels acquired before initiation of the fracturing treatment or activation of emitter 22. Detectors 16 also include electronic circuitry such as a photo-multiplier tube, a preamplifier, and a HV multiplexer, for filtering, amplifying, and digitizing the gamma energy count rates, before they are transmitted to the surface.

Also available is the option of using multiple tracer isotopes for monitoring movement of multiple stages of fluid and proppant concentration during the fracture treatment. A more sophisticated type of detector 16 can detect and classify the emissions from each type of tracer, or the detector string can include multiple types of detectors, each capable of detecting emissions caused by only one type of tracer. For example, different tracers may be used to tag fluid injected during different stages of the fracturing process, such as the pad stage, in which fluid is injected without sand proppant, and subsequent stages that have varying or increasing concentrations of sand proppant. In addition, different tracers may be used to tag different stages of acid injection, which is used in reservoirs that may not be suitable for fracturing stimulation.

In addition, those detectors 16 that are immediately adjacent to neutron source 22, labeled with numeral **16*b* in FIG. 1, also measure gamma radiation generated by neutron emissions close to the neutron source, including inelastic interactions with the tracer nuclei in the wellbore annulus. Such detectors allow surface confirmation of the level of emissions from emitter 22** and the reaction of the adjacent formation nuclei with the emitted neutrons.

The vertical movement of activated tracers 23 in the reservoir fracture is monitored by scintillometer detectors 16, which detect the increase of total gamma energy above the pre-measured baseline at the specific gamma energies characteristic of the elements used as activated tracer isotopes 23. As the fracture tip or crack propagates vertically along the hole, fracturing fluid moves up or down along the side of borehole 11, carrying tracers 23 along. The tracers 23 regularly emit gamma rays, which move through the rock formation in a random direction for a distance of perhaps one to two meters before becoming absorbed by the formation. As shown in FIG. 1, some of those gamma photons will pass through the rock formation and steel tubular elements such as casing 13 and tubing 10 and strike one of detectors 16. However, because it is unlikely that a gamma photon will happen to travel a large distance without being absorbed, it is extremely likely that the photon will strike the nearest one of detectors 16, if it hits a detector at all. Thus, a large increase in gamma radiation at one of the detectors 16 must indicate the presence of tracer-containing fluid adjacent to that detector. Note that because the gamma rays do not travel far, the inventive system will fail to detect out-of-zone fracturing only in wells that are not drilled along the fracture plane azimuth, which is a situation that is generally avoided during well drilling.

Gamma rays have a high likelihood of passing through relatively thin steel barriers without absorption, so the effectiveness of detectors 16 is not hampered much by their location inside casing 13 and tubing 10. On the other hand, tubing 10 protects detectors 16 and minitron 22 from damage from the hostile environment outside the tubing, which includes the presence of highly pressurized fluid containing abrasive particles such as quartz sand or harder proppants such as aluminum and titanium silicates.

As fluid passes detectors 16 on its way down the hole inside of casing 13, however, it does not interfere with the readings on detectors 16, because the fluid is not yet radioactivated. Thus, detectors 16 are capable of readily distinguishing fluid outside casing 13 from fluid simultaneously passing inside casing 13. Thus, the inventive system avoids the time-consuming computer processing required by present known techniques. Such processing is otherwise needed to distinguish the diffused gamma spectra associated with radioactive tracers in the formation fracture, which results in Compton scattering, from similar gamma spectra associated with identical radioactive tracers within the well-bore.

Figure 2:
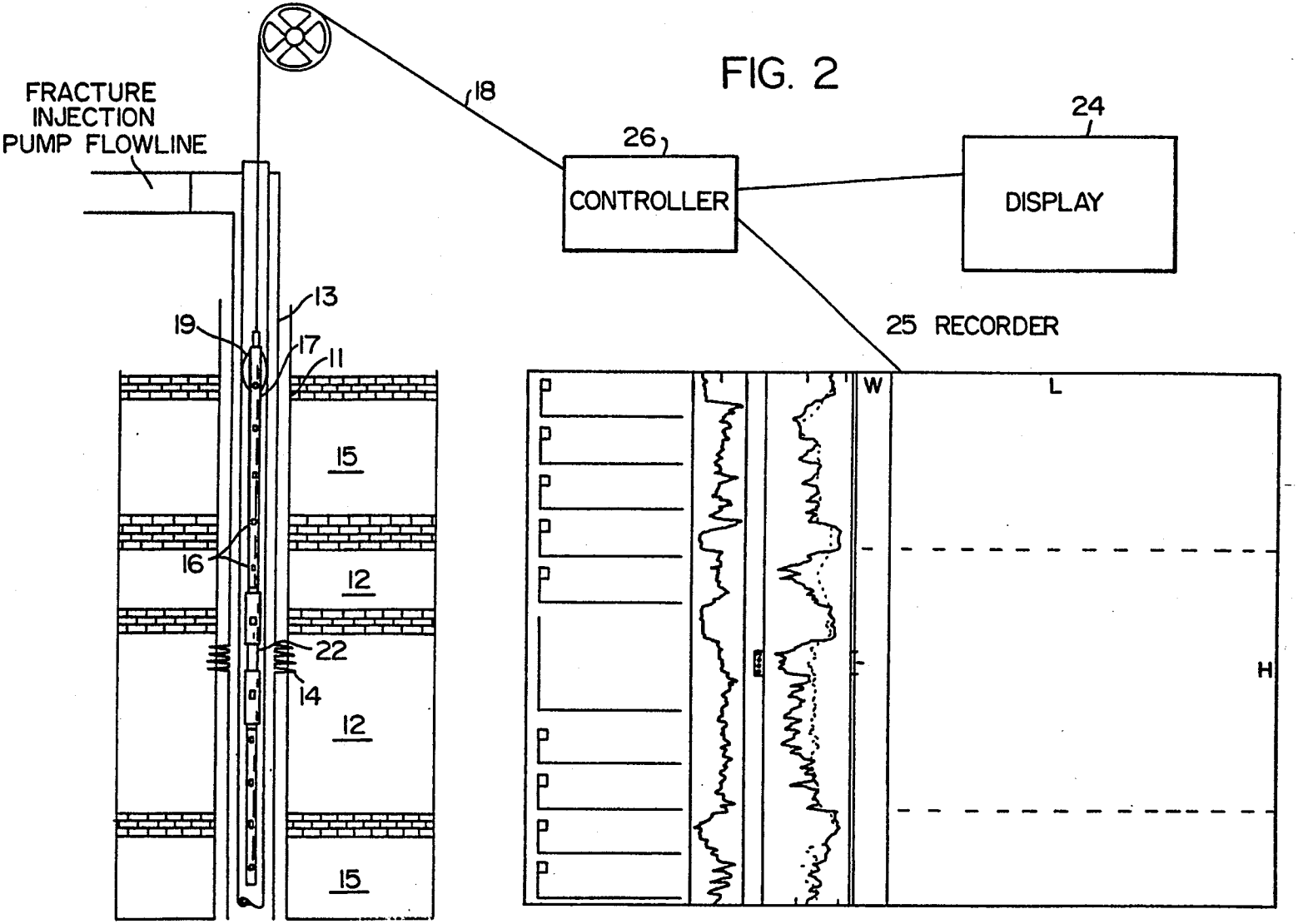
FIG. 2 is an illustrative view of a well borehole and illustrates an embodiment of the present invention including surface components.

Each detector 16 is arrayed on tool sonde 17, which also supports wiring to allow the measured and processed telemetry to pass to the surface. As illustrated in FIG. 2, a preferred embodiment of the invention also includes wellsite data acquisition and control system 26, which can include a visual display 24 or a chart recorder 25. It is preferred to provide the display or graphing capability at the well site to permit correlation with other geophysical or well data available to the operator.

Measurements taken by detectors 16 and displayed at the surface allow for the monitoring of fracture growth and consequential control of the placement of fluids and sand proppant during the various stages of the fracturing process illustrated in the sequence of FIGS. 3 through 6, each of which shows a different stage of the process. Those figures illustrate an exemplary type of graph that can appear on display 24 or recorder 25 of the preferred embodiment, which may be a printer or any other suitable output or storage device, along with a drawing illustrating an example fracturing state that could produce such readings.

Figure 3:
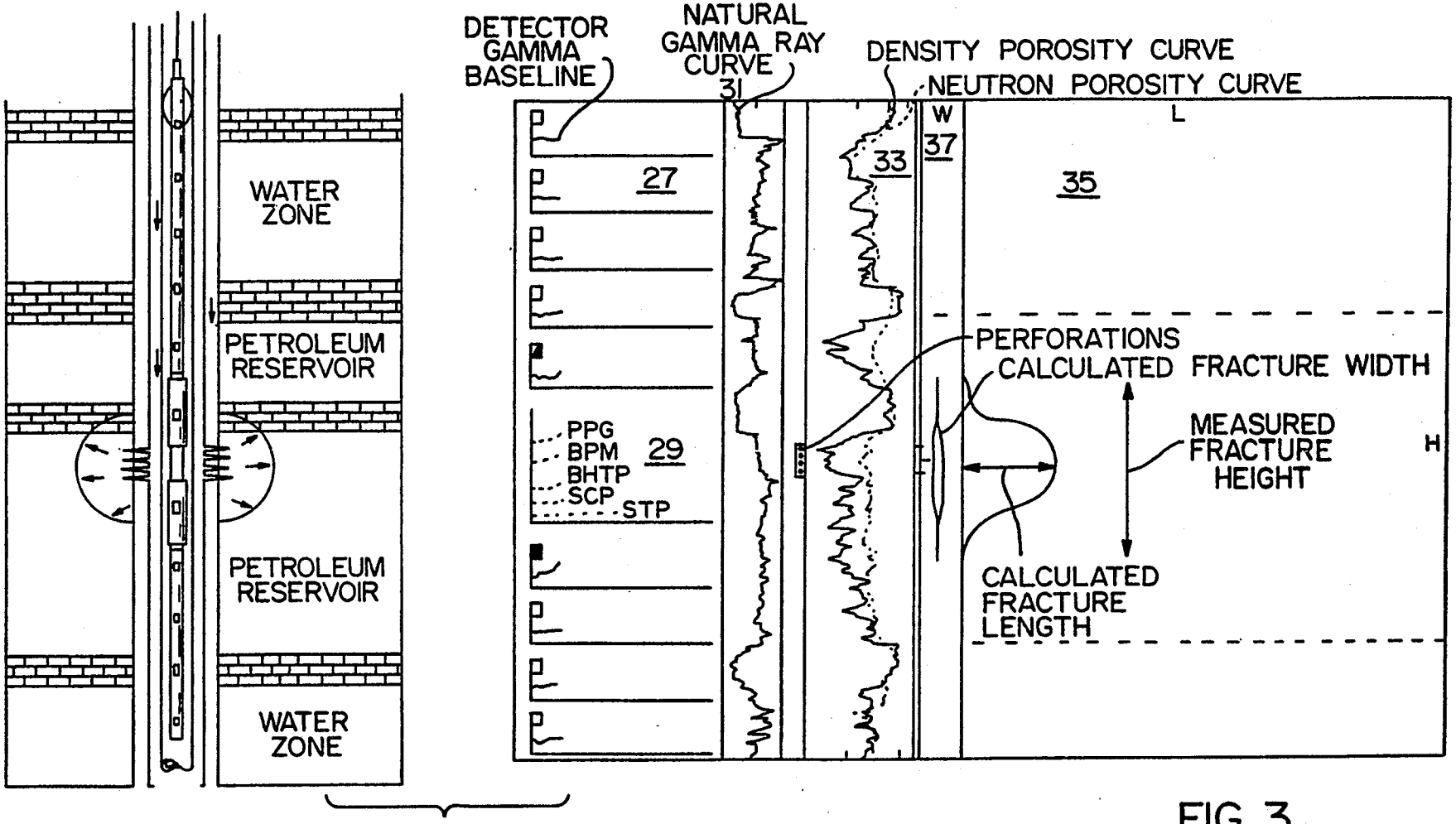
FIG. 3 is a graphical presentation of an example output of the system of the invention, showing the initiation and propagation of a hydraulic fracture during the pumping of the fluid pad and the fracture height in the formation as monitored in real time at the surface.
Figure 4:
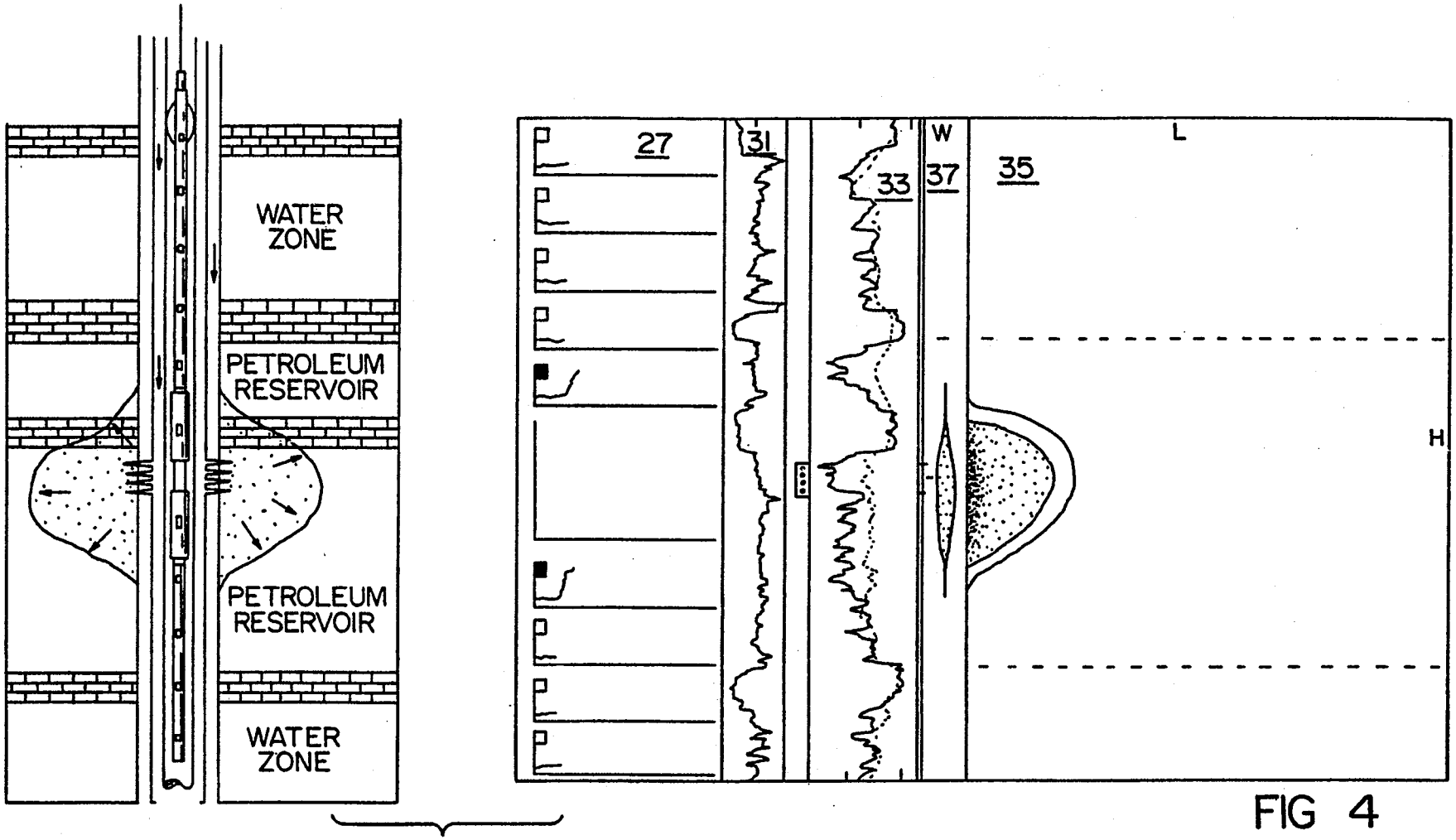
FIG. 4 is another example graphical presentation, showing the stage of pumping sand proppant in the fracturing fluid.
Figure 5:
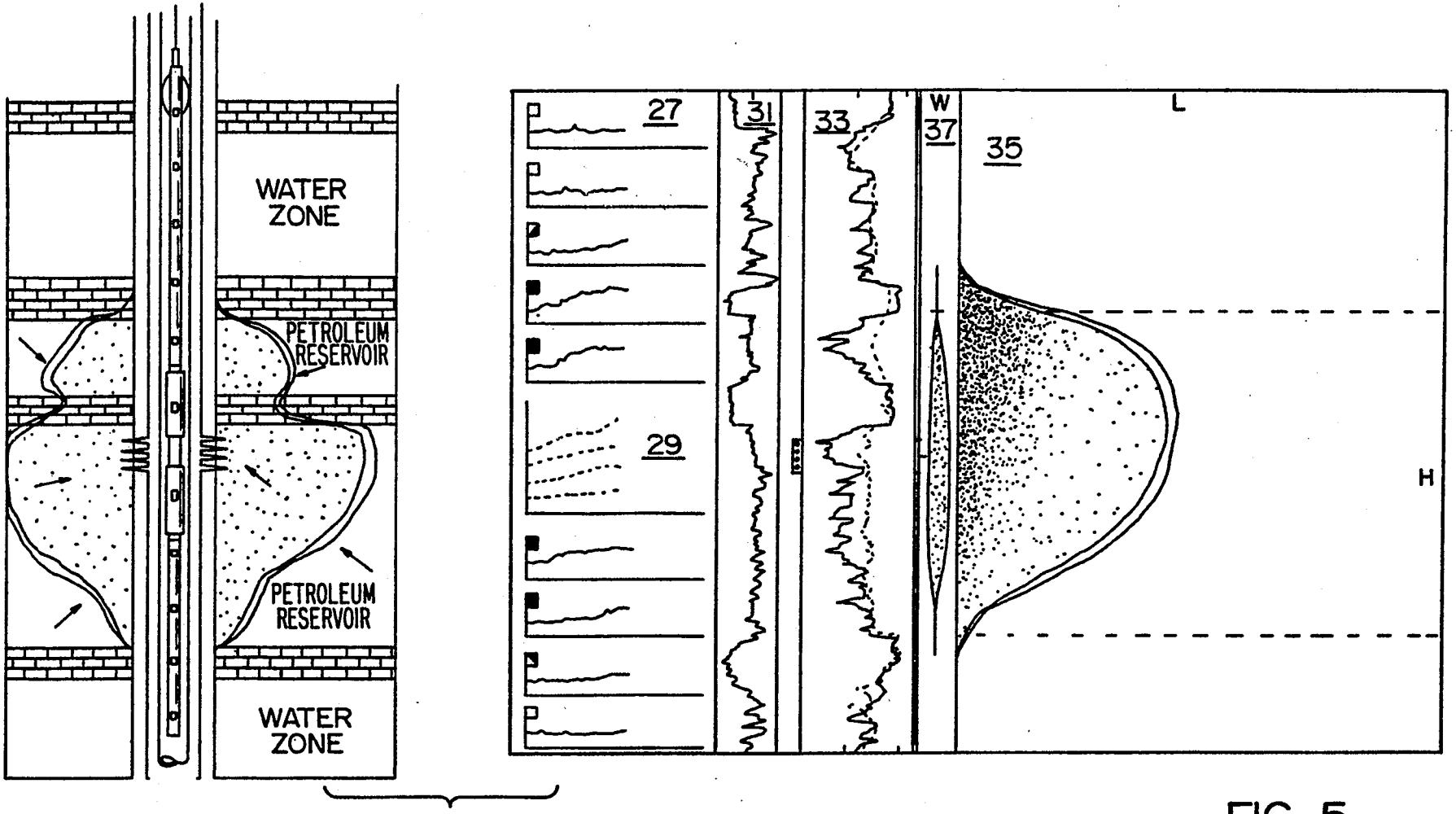
FIG. 5 is another example graphical presentation, showing the stage of the developed fracture at the end of the fracturing treatment when the induced fracture reaches-the maximum desired height.
Figure 6:
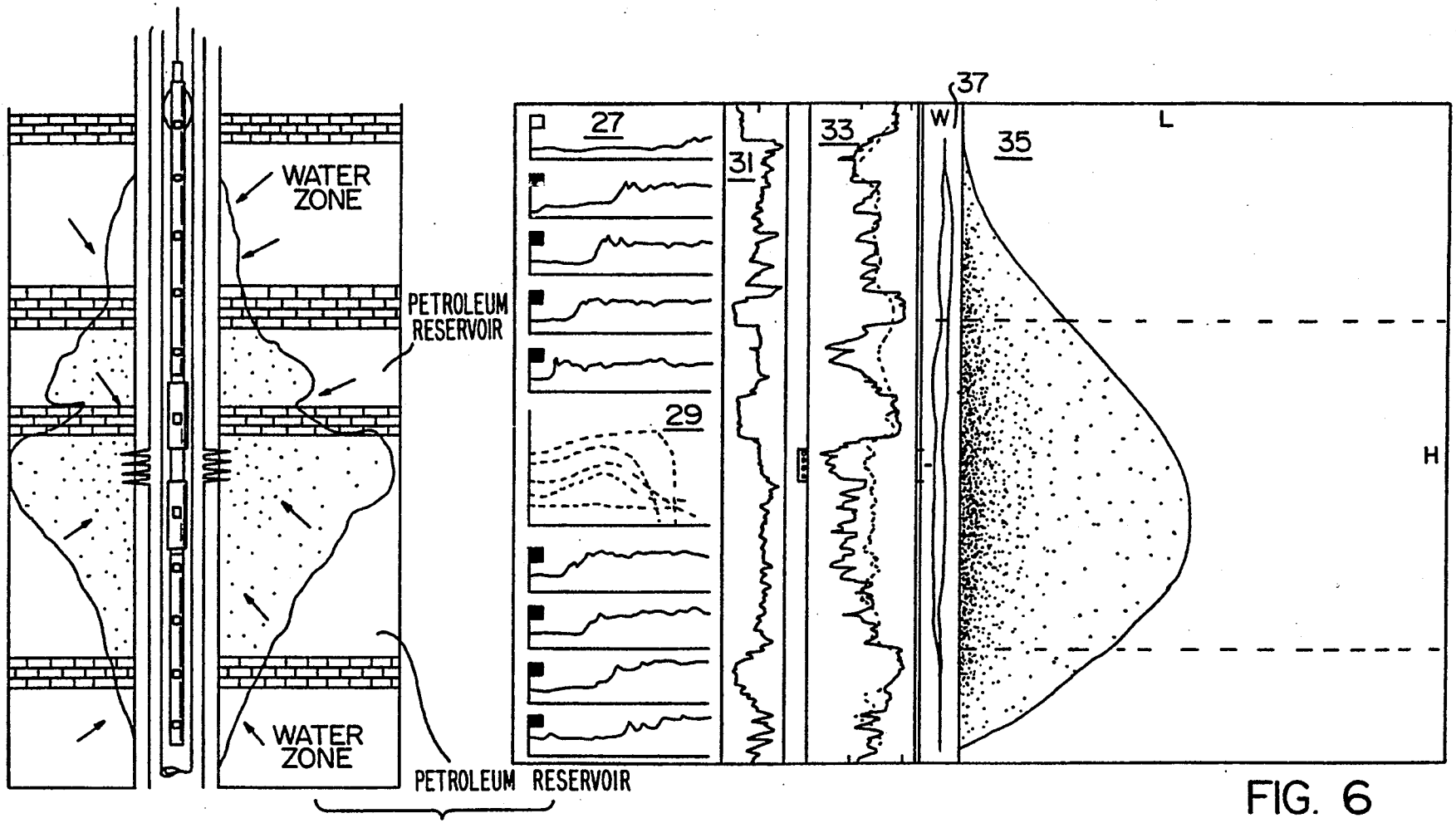
FIG. 6 is another example graphical presentation, showing an example of a well made non-commercial by induced fracture height growth in excess of critical design criteria.

FIG. 3 illustrates the readings on detectors 16 and the initial propagation of the fractures during the pumping of the "fluid pad," that is the initial pressurizing and fracturing fluid, which contains no sand proppant. FIG. 4 illustrates the detector readings and fracture propagation as sand proppant is injected into the fracturing fluid. FIG. 5 illustrates the detector readings and developed fracture at the desired end of the fracturing treatment. FIG. 6 shows the readings and fracturing for a well that has been fractured out of zone.

The graphs shown in FIGS. 3 through 6 can display gamma ray measurements 27 from each detector 16, and can display that information along with a variety of other data. In those figures, chart area 29 displays a series of variables commonly measured in fracturing jobs, including the sand and slurry concentrations, the fluid injection rate, the calculated bottom-hole treating pressure, the injection pressure at the casing, and the pressure in the tubing string. Chart area 31 displays a log of the natural gamma ray emissions along the hole, measured before the injection begins, perhaps by using a tool such as Schlumberger's NGT. Chart area 33 shows porosity logs, perhaps including density porosity (solid line) and neutron porosity (dotted line), taken before casing is placed in the wellbore.

The invention can be further automated to permit computer-processing of the gamma ray readings, such as by comparing them with a predetermined cut-off point. The square boxes in chart area 27 indicate whether the readings from a particular detector, after subtracting the baseline measurement, exceeds the cut-off level. If the cut-off is exceeded, the fracture is presumed to have grown to a height adjacent to the detector, and that information can be used to automatically produce an image of the calculated propagation of the fracture as a function of depth, such as shown in chart area 35 in the figures.

The computer system can also use known mathematical methods to infer fracture length (radial distance from the wellbore) and width (the distance that the sand has propped open the fractures in the formation) and to display the results of those calculations. Chart areas 35 and 37 in the figures illustrate one possible format for such a display.

Use of the inventive system allows more accurate measurement of fracture height, which in turn permits more accurate estimation of the fracture length. Present methods of calculating fracture length use computer-modeled mathematical derivations based on measured fracture height. Thus, a more accurate height measurement will allow more accurate length estimates. Accuracy in the estimate of fracture length is important because it allows better measurement of the drainage area of the well, which is used in well spacing, for example.

The inventive system also allows more accurate determination of proppant concentration, which is related to fracture width. Present methods assume fracture width from complicated calculations based on knowledge of physical rock properties, but the inventive system can allow a more direct approximation of fracture width using the measured level of radiation emitted by tracers tagging the proppant: The more radiation measured at a particular detector 16, the more tracer is near that detector, and therefore, the higher the sand concentration, which indicates a proportionately wider fracture.

Thus, the inventive systems and methods allow the operator to visually monitor the fracture dimensions at the well site as the fracture is propagated, that is, in real time. In response, the operator can use other, known techniques to control the height and lateral extent of the induced fracture. For example, three-dimensional models are available to predict the reaction of the fracture to variations in the pumping rate and concentration of proppant. Such models can be run and the results used in conjunction with the observed status of the fracturing to control the process more precisely.

By monitoring and observing fracture growth, it is possible in accordance with the invention both to determine reservoir fracture height and to control fracture height so as to optimize the hydraulic fracture treatment process. As shown in FIG. 5, when the operator observes that the fracture has developed vertically to a predetermined point, the operator can terminate further treatment before the fracture crack propagates beyond the objective reservoir zones and into the water zones. The predetermined point can be set by knowing the depth of the oil-water interface or other critical depth level, which is normally determined from methods such as well logging, field-production data analysis, core analysis, or other techniques.

In yet a further embodiment, the surface processing equipment may be programmed to automatically modify the treatment or to stop pumping when the detection system determines that a predetermined level of gamma radiation has reached a pre-designated critical depth, which would be close to, but before, the depth of the water zone or oil-water interface.

Aside from merely knowing when to stop the fracturing process, the inventive systems and methods permits the collection of data that can be used to alter other parameters, such as injection pumping rates, sand type or concentration, and injection pressures. The ability to more knowledgeably vary those factors provides an added dimension of control of reservoir treatments. Such control of the fracture treatment process is not possible with known techniques, which typically rely on measurement after the well-fracturing process has been completed.

For example, although in most situations fracturing occurs in vertical planes along the wellbore, in some cases the fractures can propagate laterally away from the wellbore with minimum growth in height. In those situations, the operator could pump larger amounts of sand proppant and gel fluid during a fracturing job with the real-time knowledge that productive fracturing was occurring without excessive fracture height development, so that there was little risk of treating out of zone. Such an significantly extended fracture length maximizes the reservoir drainage area and typically results in both higher sustained initial well production and better ultimate reserve recoveries. Because the inventive system permits the operator to recognize such favorable conditions, it is possible to achieve the industry goals of efficient proppant placement in the reservoir subject to the need to contain the growth of the fracture height.

Figure 7:
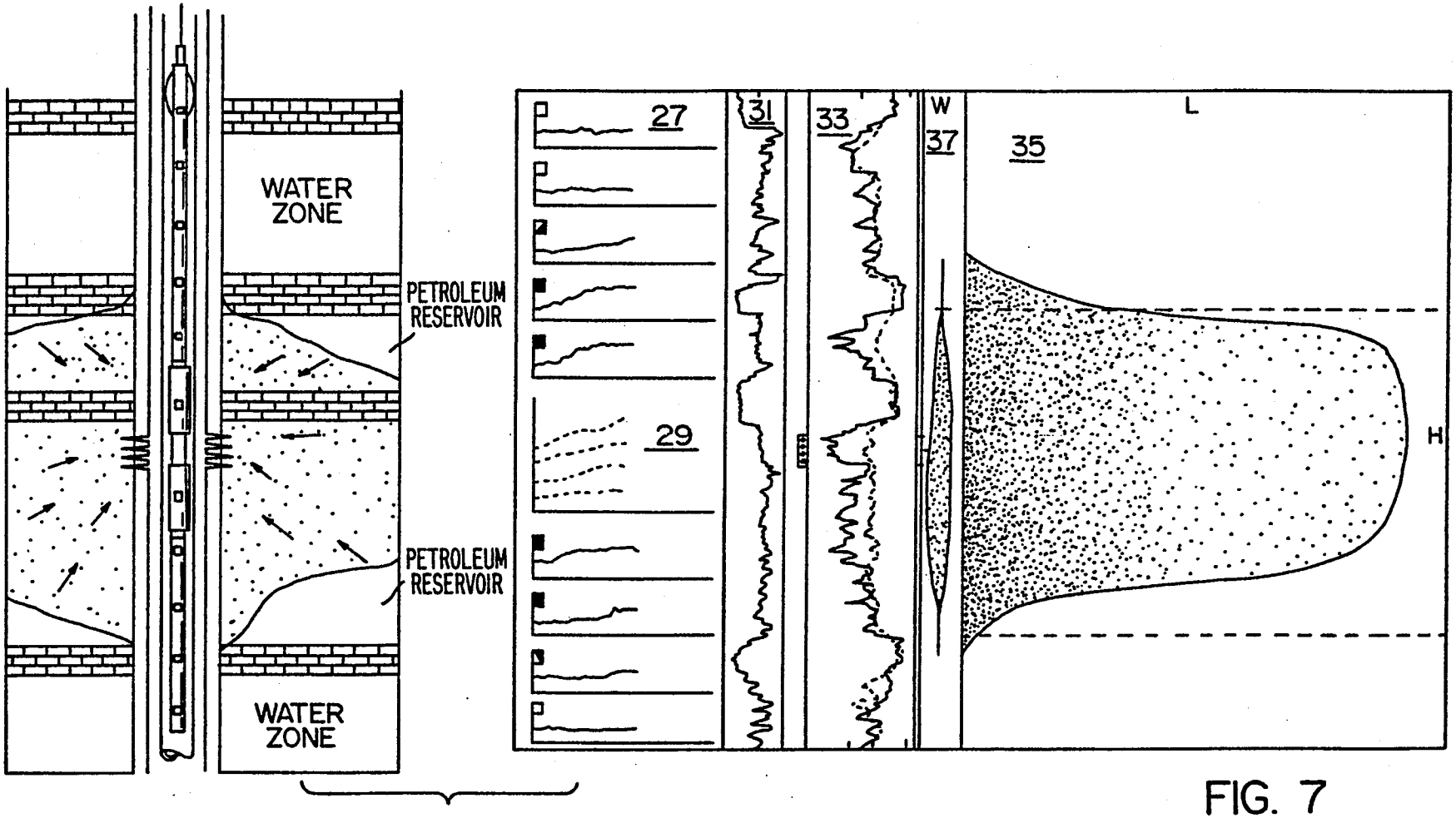
FIG. 7 is another example graphical presentation, showing a possible fracturing job that can be done, in favorable conditions, using the system of the invitation, to maximize production results.

Similarly, FIG. 7 illustrates graphically the point that recognition of the presence of strong barrier rock can allow better proppant placement and a longer fracture length than would have been possible without the use of the invention. Without the inventive system, a conservative operator would be forced to be more cautious in the fracturing treatment to avoid risking the problem of treating out of zone, which would result in a shorter fracture length, while another operator using the inventive system could monitor the fracture propagation and perform a more aggressive fracturing treatment in the illustrated circumstances without significant risk.

The inventive system is equally applicable for acidizing jobs, in which acid is used instead of fracturing fluid, or in other situations requiring localized fluid injection.

Figure 8:
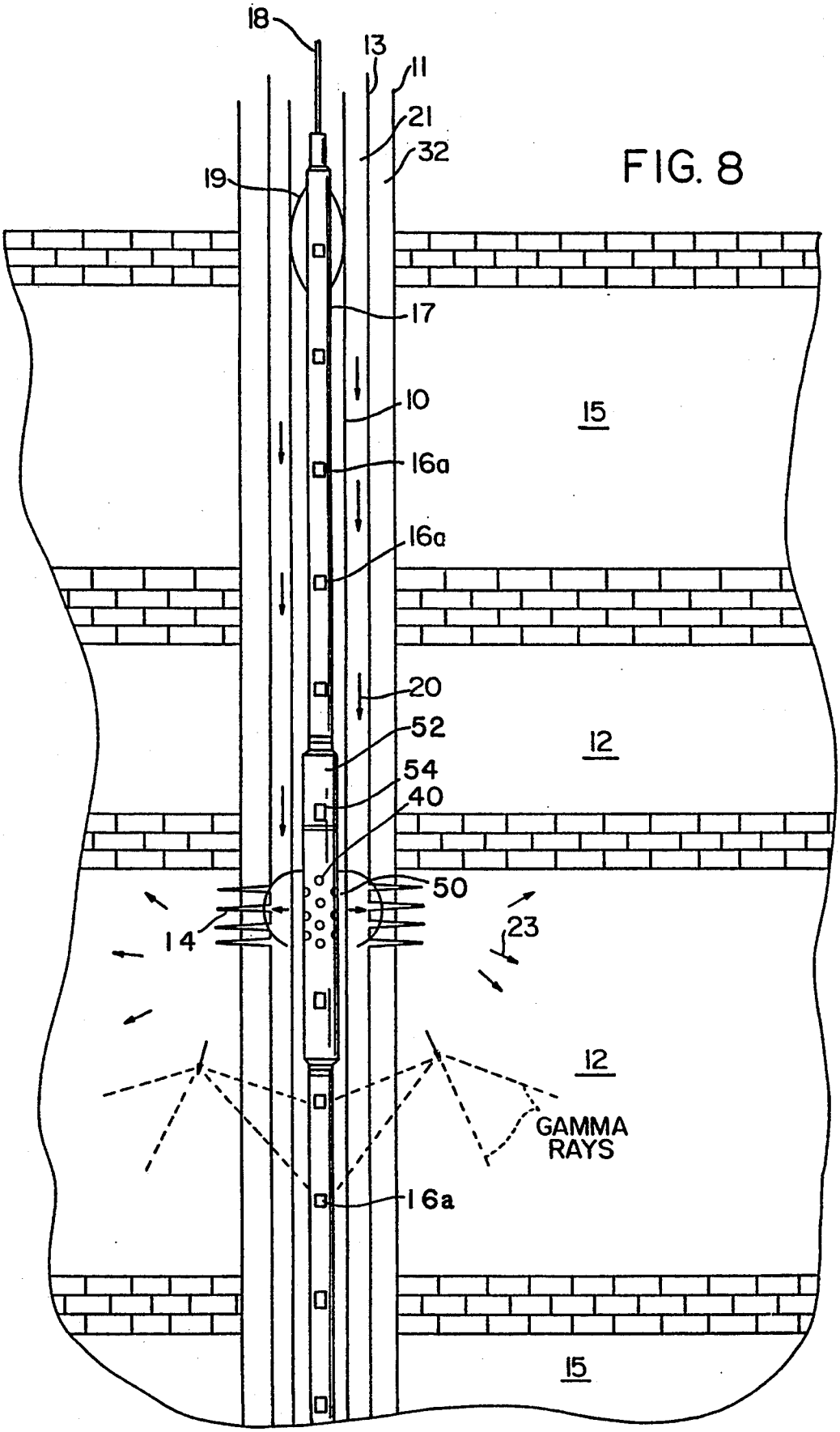
FIG. 8 is a schematic view of a well borehole illustrating an alternative embodiment of the invention using tubing-conveyed radioactive dispersal charges.

An alternative system for injecting radioactive tracers downhole is illustrated in FIG. 8. Elements 10–19, 21, 23, and 32 are as described above. In place of minitron 22, however, FIG. 8 shows a plurality of radioactive dispersal charges 40 arrayed near one or more of the perforation zones 14. Fluid 20 contains initially non-radioactive fluid that is made radioactive when some of the dispersal charges 40, such as charge 40 shown in FIG. 8, explodes, injecting radioactive tracers into fluid 20 as it passes into the formation through perforations 14. The detectors identified with numerals 16*a* form an array to detect the passage of radioactivated fluid as it passes vertically in the formation outside of cement 32, above and below the perforations 14.

The charges 40 of FIG. 8 are similar to charges widely used in the industry for creating the casing perforations such as shown at numeral 14 in FIG. 8. A variety of such perforation charges are shown and described in the book entitled "Wireline-Conveyed Perforating," published by Schlumberger Educational Services of Houston, Tex. in 1991, which is hereby incorporated by reference, and Schlumberger's Technical Data Sheets TC 01, particularly TC 01 04 and TC 01 12 entitled "Guns and Explosives for Tubing Conveyed Perforating," all of which data sheets TC 01 are hereby incorporated by reference. However, in the version of FIG. 9, the shot is replaced or supplemented with tracer material and the power of the dispersal charge may be reduced. As the Schlumberger materials indicates, however, it is possible to direct the ejected material in a particular radial direction or range of directions.

In the embodiment of FIG. 8, charges 40 are shown arrayed on tubing-conveyed carrier 50, which may be as described in the Schlumberger data sheet TC 01 04 or a similar carrier and detonator system as known in the art. Firing head 52 is coupled to carrier 50 by a detonation transfer connection. Firing head 52 may be of a variety of sorts, depending on the sort of triggering mechanism selected. Although the embodiment of FIG. 8 illustrates a firing head 52 and carrier 50 as being two different pieces and as slightly larger in diameter than tubing 17, the two can alternatively comprise a single composite tool and may match the diameter of tubing 17.

Figure 9:
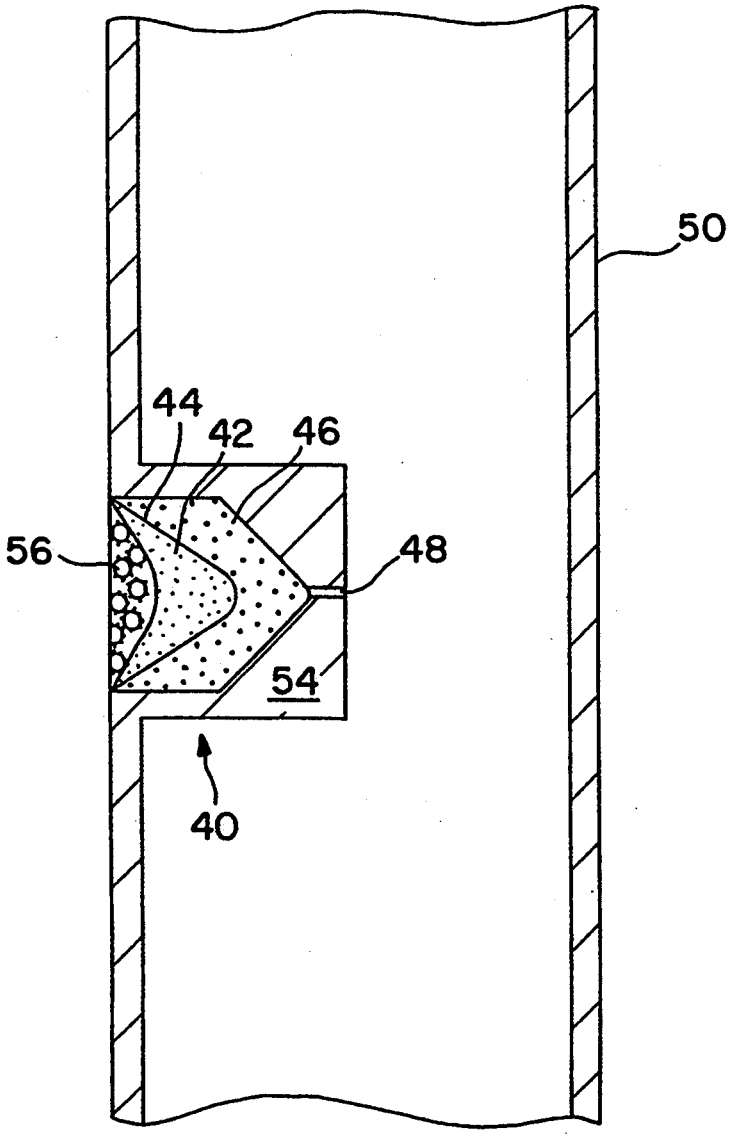
FIG. 9 is a cross-sectional view of a radioactive dispersal charge and associated carrier used with the embodiment of FIG. 8.

An example charge 40 is shown in more detail in the cross-sectional view of FIG. 9. A portion of carrier 50 is shown in cross-section with a charge 40 held in cavity 54 of carrier 50. Radioactive tracer material 42 is contained in an encapsulation envelope 44. A shaped propellant charge 46, such as black powder, can be exploded by activating electronic ignition wire or primacord 48, ejecting tracer 42, and if desired, also perforation shot 56. Charges 40 may be arrayed in a variety of configurations in carrier 50, including the triangular-shaped arrangement shown in Schlumberger's data sheet TC 01 04 and the other patterns in data sheet TC 01 12.

A preferred embodiment for the triggering mechanism utilizes a tubing-conveyed, pressure-actuated trigger, similar to the differential pressure firing head and the hydraulic time-delay firing head shown in Schlumberger's data sheets TC 01 02 and TC 01 03. As indicated in those sheets, it is known in the art to trigger perforation charges by controlling the pressure inside the tubing, or the difference in interior pressure between the tubing and the annulus, to match a preset trigger point. Such a system can be suited to trigger the dispersal charges of this invention as well, although it may be preferred to select a pressure within the tubing, rather than a differential pressure, in view of the variation of pressure in the annulus as the fracturing fluid is pumped.

Alternative trigger systems include the following: (a) radio-transmitted trigger signals, (b) wireline triggers, (c) mechanical drop-bar triggers, (d) triggering by twisting or lifting tubing 17, or (e) pre-set triggering using time delays. Schlumberger's data sheet TC 01 01 shows a bar-drop trigger system, in which a bar dropped from the surface within tubing 17 strikes a shear pin in the firing head. Heavy-duty wireline may be wrapped in a spiral pattern around the outside of tubing 17 as it is inserted, and it can then convey firing signals from a surface-actuated command to an electrical detonator downhole that can ignite a fuse or primacord.

In a radio-transmitted system, a surface-based transmitter can transmit a signal to a receiver 54 (see FIG. 8) mounted within firing head 52, which can set off the charges 40 in carrier 50. For added safety, it is preferred to configure the transmitter-receiver pair to set off the charges only in response to a coded sequence of signals, to avoid having random radio signals accidentally trigger the charges. Appropriate transmitter and receiver pairs are known in the art of directional drilling, in which surface-based signals can be sent to control the direction of a subsurface drill-head. In such a system, it may also be useful to incorporate a transmission mechanism that operates in the opposite direction, to allow gamma-ray detectors 16 to transmit their measurements to the surface. Such telemetry systems are presently used for the known art of measurement-while-drilling.

The system of FIGS. 8 and 9 allows for the injection of high concentrations of tracer materials, thereby permitting easier detection. Still, that system also retains the above-described advantage of avoiding contamination of the readings at detectors 16 from the radioactivity of fluid having surface-activated tracers as it passes the detectors on its way downhole during treatment.

Different groups of charges 40 can be triggered at different stages of the fracturing treatment, either in timed or staged sequence or upon operator command. Charges 40 in different groups should be located far enough apart, therefore, to avoid chain-reaction triggering. Selective triggering of charges 40 makes the alternative embodiment of FIG. 8 particularly useful with the above-described system of using multiple types of different tracers to tag various stages of the fracturing process. Each of the different groups of charges 40 can contain a different type of tracers, each of which is detectable by one detection capability of a combination detector 16 (or one of a pair or group of detectors 16), several of which are arrayed across a depth interval.

For example, half of the charges 40 in FIG. 8 may contain a first type of tracer, such as a Scandium-based tracer, and the operator may trigger those charges for example at the pad stage, thereby injecting those tracers into the formation. After a time, the operator may triggers the other half of the charges 40, and a second tracer type contained therein, for example an Iridium-based tracer, follows.

Depending on the type of triggering system, multiple tracer types may be trigger by one of several methods. If pressure-based triggering is used, one skilled in the art can construct a firing head 52 with two or more shear pins, detonators, and primacords, each of the shear pins set to operate at different pressures. In such a system, the lowest trigger pressure would set off the first shear pin, triggering the first group of charges 40, and the next highest trigger pressure would set off the next pin, triggering the next set of charges 40.

If wireline or radio systems are used, different groups of charges 40 can be set off by direct command signals sent by the operator or a computer from the surface. In any triggering system, alternatively the second and subsequent groups of charges can be triggered by simple time delay, measured from the time that the first charges are triggered. Schlumberger's data sheet TC 01

03 shows a hydraulic time-delay firing head, which is disclosed as suited for setting off all of the charges a specified time after the pressure reaches a user-set trigger point. However, such a firing head can be easily modified to trigger some of the charges immediately and other of the charges after the preset time delay.

Figure 10:
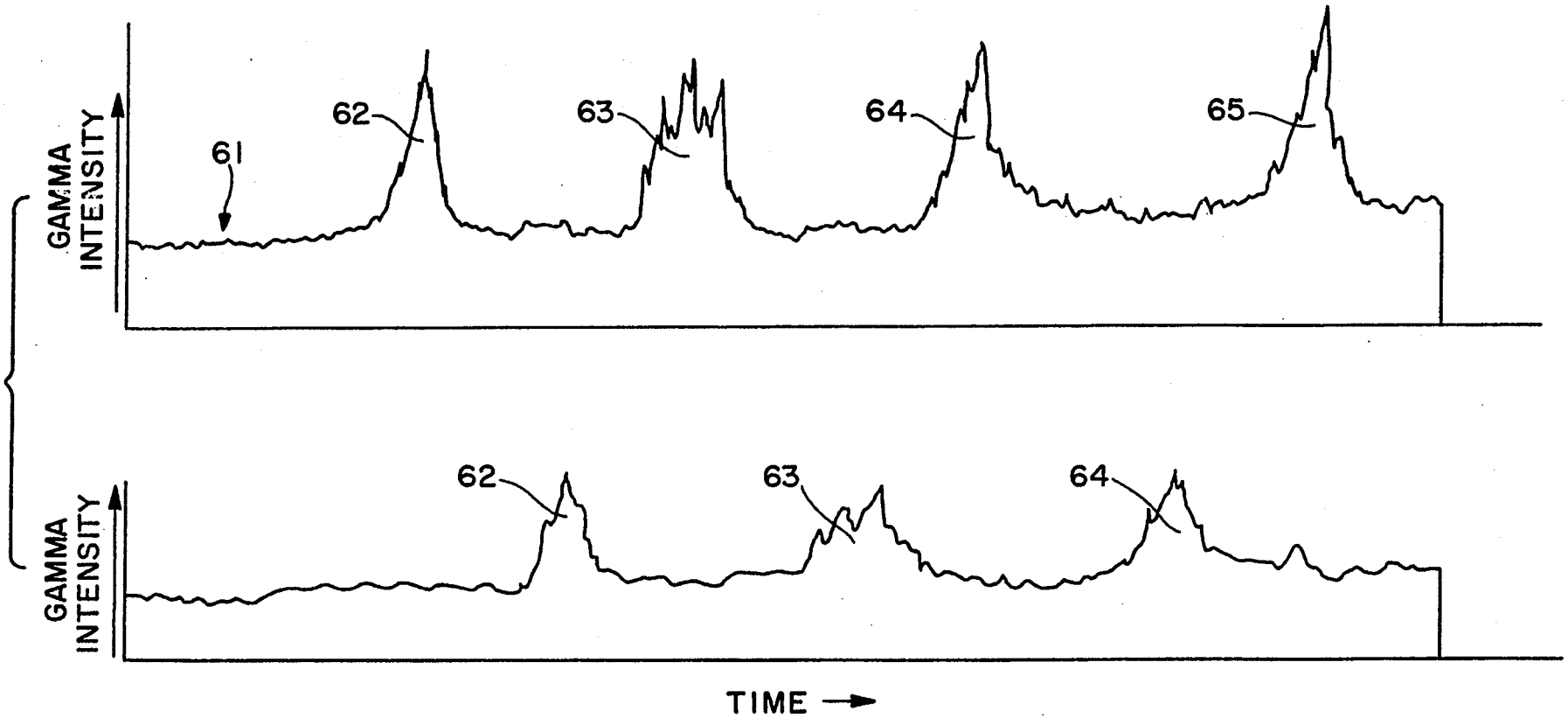
FIG. 10 is an example graphical presentation of the readings on two detectors when activated using an embodiment of FIG. 8 that can inject multiple sorts of tracers.

FIG. 10 shows illustrates graphically an example of possible readings on two detectors 16 of FIG. 8 as multiple tracer types are injected. The first detector might be just above the perforations 14, and the second detector a distance above the first. The lower tracing of FIG. 10 illustrates the readings on the first detector, and the upper tracer illustrates the readings on the second detector. Numeral 61 indicates the portion of the reading showing the level of background gamma radiation before initiation of the fracturing treatment. As the first tracer, associated with the pad stage of treatment, expands into the formation, it is detected first by the lower detector and then by the upper detector, as shown at numeral 62. The second tracer, associated with the first proppant stage of treatment, is subsequently detected in turn by the two detectors, as shown at numeral 63. If the system is so configured, third and subsequent tracers may also be injected, representing later proppant stages, and also detected sequentially, as indicated at numerals 64 and 65. Although the readings from only two detectors are shown, similar readings can be generated by additional combination detectors arrayed at other vertical locations, allowing the operator to monitor the progress of the various types or concentrations of injected material.

The system described above in connection with FIGS. 8–10 can be used simultaneously with conventional fracturing treatment operations, allowing for cost-effective combination treatments.

The inventive systems also have application for monitoring of injection of cements, acids, gels or resins, which are sometimes used to attempt to remedy the effects of an out-of-zone fracturing treatment. In one such remedial technique, the operator pumps heavy proppant in a thin, gel-type fluid into the lower portion of a productive zone, in an attempt to form a barrier as the heavy material settles. Then, regular proppant is injected with the hope of increasing fracturing in the producing zone above the barrier, and the barrier is trusted to block water flow from below the productive zone.

Although the invention has been described with reference to specific embodiments, many modifications and variations of such embodiments can be made without departing from the innovative concepts disclosed.

Thus, it is understood by those skilled in the art that alternative forms and embodiments of the invention can be devised without departing from its spirit and scope. The foregoing and all other such modifications and variations are intended to be included within the spirit and scope of the appended claims.

I claim:

1. A method for monitoring the hydraulic fracturing of a geologic formation traversed by a well borehole, comprising:

(a) fracturing the formation by pumping a mixture of particles and fluid into the borehole to create hydraulic pressure on the formation at a predetermined depth;

(b) adding radioactivity as the mixture enters the fracturing formation; and (c) while the mixture is being pumped, detecting spectral emissions from the radioactive mixture with a plurality of detectors vertically spaced in the borehole over a selected depth interval.

2. The method of claim 1 wherein adding radioactivity comprises:

(a) placing near the entry to the formation a container holding a quantity of radioactive tracer material; and (b) breaching the container to make the fluid radioactive as the mixture passes the emitter and enters the fracturing formation.

3. The method of claim 2 wherein:

(a) the tracer comprises an isotope that emits characteristic gamma radiation; and (b) detecting spectral emissions comprises using sodium-iodide scintillometers to detect the gamma radiation at predetermined energy levels.

4. The method of claim 1 further comprising injecting into the mixture a plurality of different tracers to tag different stages of the fracturing process.

5. The method of claim 2 wherein breaching the container is performed by detonating an explosive charge also held in the container.

6. The method of claim 1 further comprising the act, performed before initiating fracturing, of arraying in the borehole a plurality of detectors above the location where the fluid enters the fracturing formation and a plurality of detectors below that location.

7. The method of claim 1 further comprising displaying the detected emissions at the surface adjacent to the borehole while fracturing is ongoing.

8. The method of claim 1 further comprising using the detected spectral emissions to estimate at least one physical parameter of the fracture selected from the group of fracture height, fracture length, and fracture width.

9. The method of claim 8 further comprising using the detected emissions to determine the movement of the radioactive material and automatically graphing said movement as a function of depth.

10. The method of claim 1 further comprising employing the detected emissions to control at least one parameter of the fracturing process affecting fracture growth.

11. The method of claim 10 wherein employing the detected emissions to control at least one parameter of the fracturing process includes determining when to terminate the fracturing process.

12. The method of claim 10 wherein employing the detected emissions to control at least one parameter of the fracturing process includes automatically varying at least one parameter of the fracturing process affecting fracture growth in response to detected emissions.

13. A method for monitoring the hydraulic fracturing of a geologic formation traversed by a well borehole, comprising:

(a) placing in the borehole at a selected depth a plurality of explosive charges containing a radioactive tracer material;

(b) arraying in the borehole a plurality of sodium-iodide scintillometers above the charges and a plurality of sodium-iodide scintillometers below the charges, which scintillometers are vertically spaced in the borehole over a selected depth interval;

(c) activating the scintillometers to take a baseline measurement of spectral emissions at predetermined energy levels;

(d) fracturing the formation by pumping fluid into the borehole to create hydraulic pressure on the formation at the selected depth;

(e) exploding at least some of the charges to inject the radioactive tracers into the fluid as the fluid passes the charges and enters the formation;

(f) detecting with the scintillometers spectral emissions from the radioactive tracers at the predetermined energy levels;

(g) displaying the detected emissions at the surface adjacent to the borehole while fracturing is ongoing;

(h) using the detected spectral emissions to determine the movement of the tracers;

(i) automatically graphing said movement as a function of depth; and (j) employing the detected emissions to control at least one parameter of the fracturing process affecting fracture growth.

14. The method of claim 13 wherein employing the detected emissions to control at least one parameter of the fracturing process includes determining when to terminate the fracturing process.

15. The method of claim 14 wherein employing the detected emissions to control at least one parameter of the fracturing process includes automatically varying at least one parameter of the fracturing process affecting fracture growth in response to detected emissions.

16. The method of claim 13 wherein some of the charges contain a first radioactive tracer material and some of the charges contain a second radioactive tracer material, wherein part (e) comprises exploding the charges containing the first tracer, further comprising subsequently exploding the charges containing the second tracer, and wherein part (f) comprises detecting spectral emissions from the two tracers at distinct energy levels.

17. An apparatus for monitoring the hydraulic fracturing of a geologic formation traversed by a well borehole, comprising:

(a) a plurality of explosive charges containing a radioactive tracer material, located at a selected depth in a borehole;

(b) a triggering mechanism at the surface coupled to the downhole charges;

(c) an array of downhole sodium-iodide scintillometers above the charges and an array of sodium-iodide scintillometers below the charges, which scintillometers are vertically spaced in the borehole over a selected depth interval and are configured to detect spectral emissions from the tracer material; and (d) a display at the surface coupled to the scintillometers.

18. The apparatus of claim 17 wherein the scintillometers are coupled to a computer configured to employ detected spectral emissions to control at least one parameter of the fracturing process affecting fracture growth by sending command signals to a fracturing-process control device.

19. The apparatus of claim 17 wherein the charges comprise a casing separately enclosing explosive material and radioactive tracer material.

20. The apparatus of claim 17 wherein some of the charges contain one radioactive tracer material and other of the charges contain another radioactive tracer material.

* * * * *